US007737915B1

(12) United States Patent
Vishlitzky

(10) Patent No.: US 7,737,915 B1
(45) Date of Patent: Jun. 15, 2010

(54) TECHNIQUES FOR DISPLAYING INFORMATION THROUGH A COMPUTER DISPLAY

(75) Inventor: Natan Vishlitzky, Brookline, MA (US)

(73) Assignee: EMC Corporation, Hopkinton, MA (US)

( * ) Notice: Subject to any disclaimer, the term of this patent is extended or adjusted under 35 U.S.C. 154(b) by 898 days.

(21) Appl. No.: 11/502,017

(22) Filed: Aug. 10, 2006

(51) Int. Cl.
*G09G 5/00* (2006.01)

(52) U.S. Cl. ..... 345/2.3; 709/250

(58) Field of Classification Search ..... 345/204, 345/1.1–1.3, 2.1–2.3; 348/14.02–14.1, 14.11; 715/764, 718; 709/250
See application file for complete search history.

(56) References Cited

U.S. PATENT DOCUMENTS 5,579,239 A 11/1996 Freeman et al.
5,684,716 A 11/1997 Freeman
5,790,787 A * 8/1998 Scott et al. ..... 709/250
6,546,262 B1 4/2003 Freadman
7,027,768 B2 4/2006 Hill
7,028,264 B2 4/2006 Santoro et al.
2001/0055373 A1* 12/2001 Yamashita ..... 379/90.01
2003/0085998 A1* 5/2003 Ramirez-Diaz et al. ..... 348/143
2004/0080537 A1* 4/2004 Adler ..... 345/764
2004/0207719 A1* 10/2004 Tervo et al. ..... 348/14.02

* cited by examiner

*Primary Examiner*—Chanh Nguyen
*Assistant Examiner*—Adakou Foli
(74) *Attorney, Agent, or Firm*—BainwoodHuang

(57) ABSTRACT

A computer display includes a screen, a workstation port configured to receive a workstation signal from a workstation controller, and a wireless port configured to receive an external signal from an external device. The external device is different than the workstation controller. The computer display further includes a display circuit coupled to the screen, the workstation port and the wireless port. The display circuit is configured to output (i) workstation information on the screen in response to the workstation signal from the workstation controller and (ii) external information on the screen in response to the external signal from the external device. Accordingly, the user is now capable of enjoying the image quality of a larger video display (e.g., a 15-inches, 17-inches, 19-inches, 21-inches, large projection screens, etc.).

3 Claims, 4 Drawing Sheets

TECHNIQUES FOR DISPLAYING INFORMATION THROUGH A COMPUTER DISPLAY

BACKGROUND

Cellular telephones (or simply cell phones) are small, transportable communications devices that allow users to remotely initiate and answer phone calls. Such phones are similar to traditional telephones but include radio transmitters and receivers that enable users to enjoy portable telephone-style communications over radio frequencies which have been designated to operate as cell phone channels.

Some cell phones include miniature video screens that provide video output to users. Such screens provide users with visual information thereby making it easier for users to program their cell phones, look-up and dial pre-programmed phone numbers, identify the sources of incoming calls, view text messages, and so on.

Some cell phones are even equipped with digital cameras that enable users to take digital pictures. Such digital pictures can be temporarily stored in cell phone memory, as well as sent through cell phone channels to other users for viewing.

SUMMARY

Unfortunately, there are deficiencies with the above-described conventional cell phones. For example, the miniature video screens of conventional cell phones are not good at showing detail due to their size and minimal pixel density. In particular, it may be burdensome and awkward for users to view certain types of displayed information through the miniature video screens (e.g., detailed digital images, video streams, subscriber informational services, etc.). Such limitations on image quality limit the value of these conventional cell phones as portable sources of visual information. Furthermore, such miniature video screens cannot be made larger without making significant sacrifices to other desirable cell phone features (e.g., size, shape, weight, power consumption, and so on).

Embodiments of the invention are directed to techniques which enable a user to display information on a computer display (e.g., a desktop computer monitor) through a wireless interface. Such an interface is capable of receiving external information from an external device (i.e., a device other than the primary computer processor of a common workstation) such as a cell phone configured to directly communicate with the computer display wirelessly. As a result, if such a computer display is available to the cell phone user (e.g., the user is at a location where there is such a computer display available), the user is not limited to viewing the miniature video display of a cell phone. Rather, the user is now capable of viewing better image details of the cellular phone video output on the computer display.

One embodiment is directed to a computer display including a screen, a workstation port configured to receive a workstation signal from a workstation controller, and a wireless port configured to receive an external signal from an external device. The external device is different than the workstation controller. The computer display further includes a display circuit coupled to the screen, the workstation port and the wireless port. The display circuit is configured to output (i) workstation information on the screen in response to the workstation signal from the workstation controller and (ii) external information on the screen in response to the external signal from the external device. Accordingly, the user is now capable of enjoying the image quality of a larger video display (e.g., a 15-inches, 17-inches, 19-inches, 21-inches, large projection screens, etc.).

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the invention are directed to techniques which enable a user to display information on a computer display (e.g., a desktop computer monitor) through a wireless interface. Such an interface is capable of receiving external information from an external device (i.e., a device other than the computer processor) such as a cellular telephone (or simply cell phone) configured to directly communicate with the computer display in a wireless manner. As a result, if such a computer display is available to the cell phone user (e.g., the user is at a location where there is such a computer display available), the user is not limited to viewing the miniature video display of a cell phone. Rather, the user is now capable of viewing cellular phone video output (e.g., a detailed digital picture, a video stream, live video conferencing, etc.) on the computer display.

Figure 1:
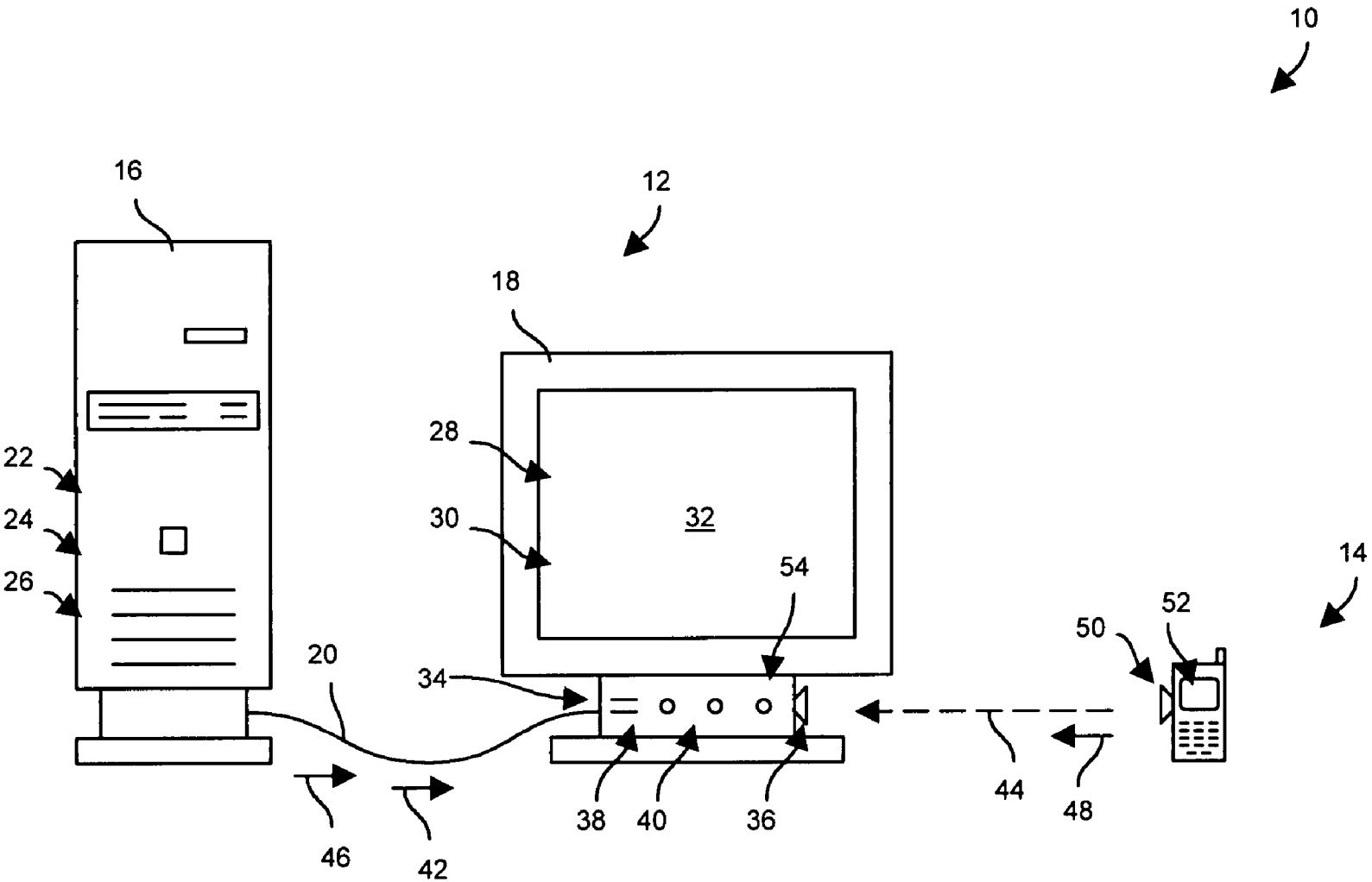
FIG. 1 is a diagram of a computerized system which is equipped with a computer display having a wireless interface.

FIG. 1 is a diagram of a computerized system 10 which is equipped with a computer display having a wireless interface. In particular, the computerized system 10 includes a workstation 12 and a portable device 14 which is external to the workstation 12. The workstation 12 includes a controller 16, a computer display 18 and a computer monitor cable 20 which connects the controller 16 to the computer display 18 in a hardwired manner. The workstation controller 16 includes a set of microprocessors 22 running an operating system 24 and higher level applications 26 in the traditional sense. The workstation controller 16 receives input from a user through a keyboard and a mouse which are omitted from FIG. 1 for simplicity. The workstation controller 16 provides user output to the computer display 18 through the computer monitor cable 20. In some arrangements, such user output is a desktop view 28 with one or more graphical user interfaces (GUIs) 30. The workstation controller 16 is further capable of connecting to a computer network to enable the controller 16 to communicate with other computerized devices (e.g., other workstations, the Internet, etc.).

In some arrangements, the external portable device 14 is a hand held device with a small screen. Along these lines, the external portable device 14 will be described further in the context of a cell phone. Nevertheless, it should be understood that the external portable device 14 can be things other than a cell phone such as a digital camera, a movie camera, a portable television, and so on.

The computer display 18 includes a screen 32, a workstation port 34, a wireless port 36 and a display circuit 38. As will be explained in further detail shortly, the display circuit 38 is coupled to the screen 32, the workstation port 34 and the wireless port 36 to provide selective rendering of video information from the workstation controller 16 and the external portable device 14. The display circuit 38 includes a set of user controls 40 (e.g., buttons, dials, knobs, etc.) that enable the user to control a variety of visual aspects of the screen 32 (e.g., brightness, contrast, color settings, etc.).

During operation, the workstation port 34 is configured to receive a workstation signal 42 from the workstation controller 16 through the compute monitor cable 20. The wireless port 36 is configured to receive an external signal 44 from the external portable device 14 in a wireless manner. The display circuit 38 is configured to output (i) workstation information 46 (e.g., email, a word processor application, specialized GUIs, other general purpose computer applications, etc.) on the screen 32 in response to the workstation signal 42 from the workstation controller 16 and (ii) external information 48 (e.g., a copy of cell phone video output) on the screen 32 in response to the external signal 44 from the external device 14.

As just mentioned, the workstation signal 42 from the workstation controller 16 is a traditional electrical signal through the computer monitor cable 20. In contrast, the external signal 44 from the external portable device 14 is a high-bandwidth wireless signal which is capable of carrying high speed video data (e.g., Bluetooth, infrared, RF signals, etc.). As recently mentioned, and by way of example, the external device 14 is described hereinafter as a cell phone having a transmitter 50 which outputs a copy of the cellular phone video output on the external signal 44 (i.e., the video information normally output on the miniature video display 52 of the cell phone) in a manner similar to that of cell phones which transmit a wireless audio output to a remote headset (e.g., an ear piece) in a hands-free manner in lieu of providing the audio output through the ear speaker of the cell phone. Accordingly, with the cell phone video output now shown on the computer display 18, the user is allowed to enjoy the benefits of the computer display screen 32 (e.g., clarity, higher resolution, truer color, etc.) which is larger than the miniature cell phone display 52.

In some arrangements, the set of user controls 40 includes a switch 54 which enables the user to select which information is currently displayed on the screen 32. That is, depending on the particular setting of the switch 54, the screen 32 outputs the workstation information 46 only, the external information 48 only, or both the workstation information 46 and the external information 48 concurrently in different portions of the screen 32 (e.g., in different windows or panels, as a picture-in-picture, etc.). Further details will now be provided with reference to FIG. 2.

Figure 2:
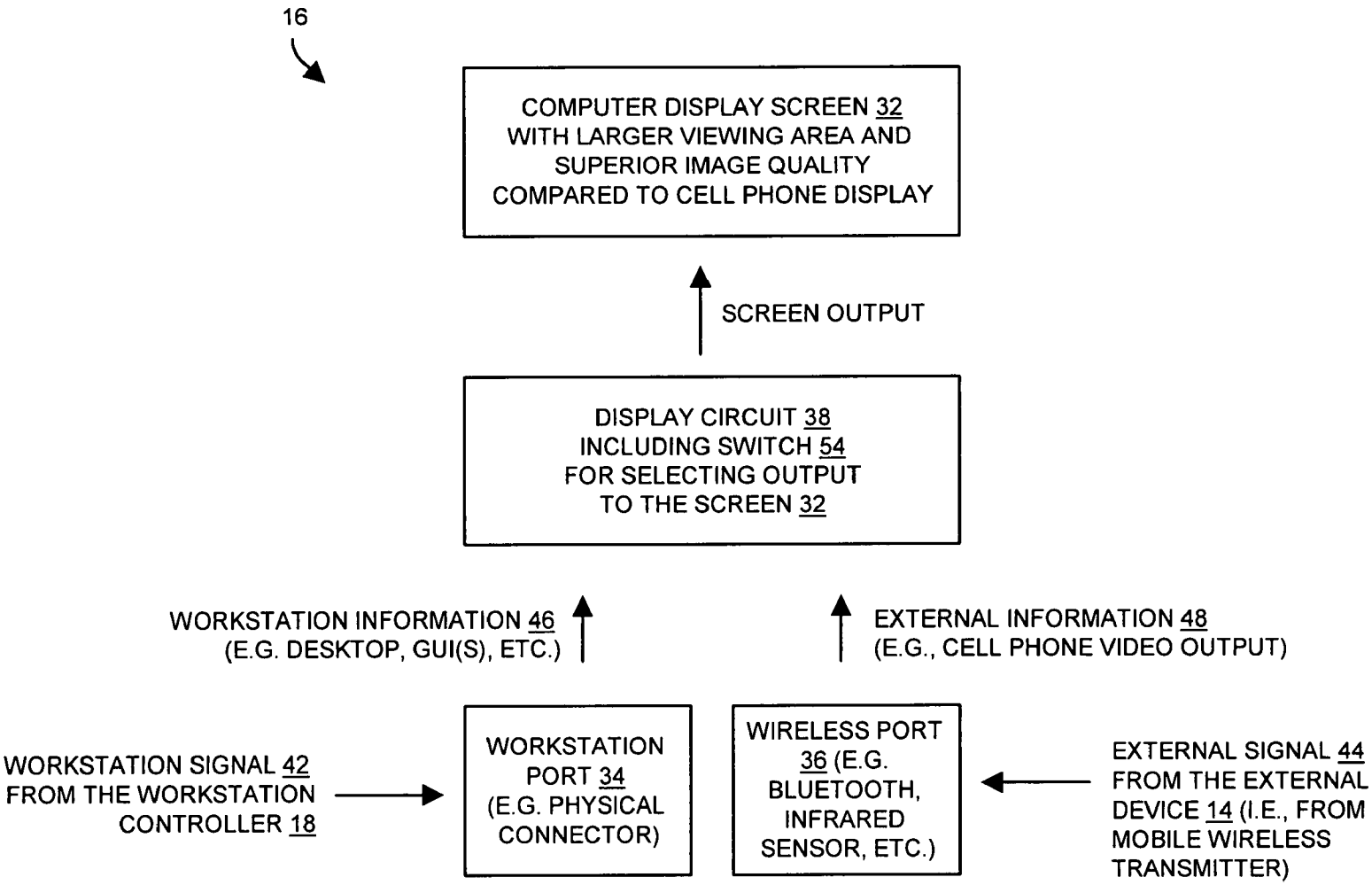
FIG. 2 is a block diagram of the computer display of FIG. 1.

FIG. 2 is a block diagram of various components of the computer display 18. As explained above in connection with FIG. 1, the display circuit 38 of the computer display 18 is capable of outputting, on the computer display screen 32, the workstation information 46 in response to the workstation signal 42 received from the workstation controller 16 through the computer monitor cable 20. Additionally, the display circuit 38 of the computer display 18 is capable of outputting, on the screen 32, the external information 48 in response to the external signal 44 received from the transmitter 50 of the external device 14. Such rendering is capable of occurring at different times or concurrently depending on the settings of the switch 54. In some arrangements, the switch 54 has a first setting (or position) to output only the workstation information 46, a second setting to output only the external information 48, and a third setting to concurrently output both the workstation information 46 and the external information 48.

The transmitter 50 of the external device 14 is a mobile wireless transmitter similar to those that provide audio input to a remote headset or ear piece. In the context of the external device 14 being a cell phone, the mobile wireless transmitter is preferably built into or packaged into the cell phone to enjoy protection offered by the cell phone housing and battery power offered by the cell phone battery. Bluetooth and infrared signaling are two wireless communications technologies among others which are suitable for conveying the external signal 44 from the transmitter 50 to the wireless port 36 of the computer display 18.

It should be understood that, as the display circuit 38 processes the workstation signal 42 and the external signal 44, the display circuit 38 maintains isolation (i.e., security) between the controller 16 of the workstation 12 and the external device 14. Specifically, suppose that the owner of the workstation 14 is different than the user of the external device 14 (a cell phone user). Further suppose that the owner of the workstation 14 has confidential information stored on the controller 16 of the workstation 12. The owner of the workstation 14 may nevertheless allow the user of the external device 14 to utilize the display circuit 38 without compromising security of the workstation controller 16 or a network to which the workstation controller 16 connects. To this end, the owner simply does not allow the user of the external device 14 to access the controller 16 (e.g., as offered by a password mechanism or similar authentication scheme), but simply directs the computer display 18 (e.g., by setting the switch 54) to output the external information 48 from the external device 14 (e.g., cellular phone video output). Such isolation of the workstation controller 16 prevents external intrusion into the workstation controller 16 by the external device 14 (e.g., a cellular phone). Moreover, since the switch 54 is located on the computer display 18, there is no need for the user of the cell phone to log into or otherwise operate the workstation controller 16.

At this point, it will be appreciated that the external device 14, i.e., a cell phone having a cellular phone display configured to render cellular phone video output to a user, is capable of bringing enhanced value to the cell phone user. For example, the cell phone user may be deterred from utilizing certain features of the cell phone if the user is restricted to using only the cellular phone display (e.g., subscriptions to various information databases or live transmissions due to poor image quality). However, with access to the larger computer display screen 32 of the computer display 18 now available (i.e., with the display controller 38 of the computer display 18 available to extract a copy of the cellular phone video output), the user is in a better position, and thus more enticed, to take advantage of such features. Further details will now be provided with reference to FIGS. 3 and 4.

Figure 3:
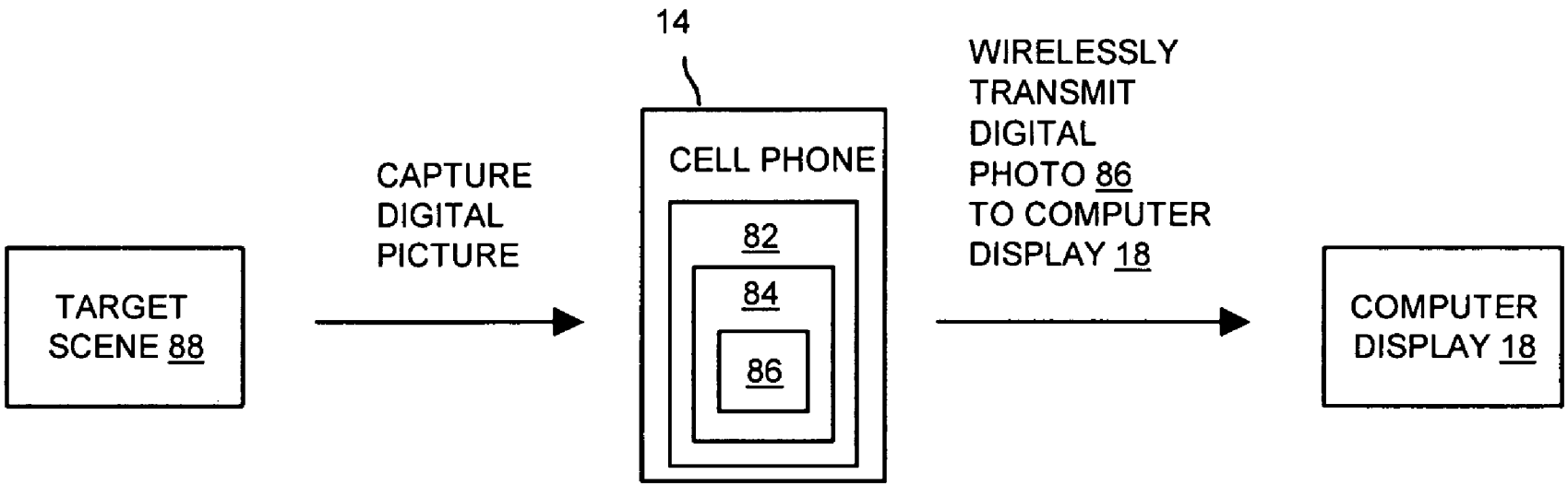
FIG. 3 is a block diagram of an information pathway which enables a user to view certain cellular phone video output on the computer display of FIG. 1.

FIG. 3 is a block diagram of an information pathway which enables a user to view, as cellular phone video output, a digital photo on the computer display 18. Here, the external device 14 is a cell phone 80 having a digital camera 82. The digital camera 82 includes memory 84 to store digital images taken by the camera 82.

During operation, the user operates the digital camera 82 to capture an image 86 of a target scene 88. The user then directs the mobile wireless transmitter 50 (e.g., using Bluetooth technology, also see FIG. 1) of the cell phone to transmit the image 86 to the computer display 18. Accordingly, the user can then view the digital photo on the screen 32 of the computer display 18. Such rendering provides better image quality than that offered by the miniature video display of the cell phone.

Figure 4:
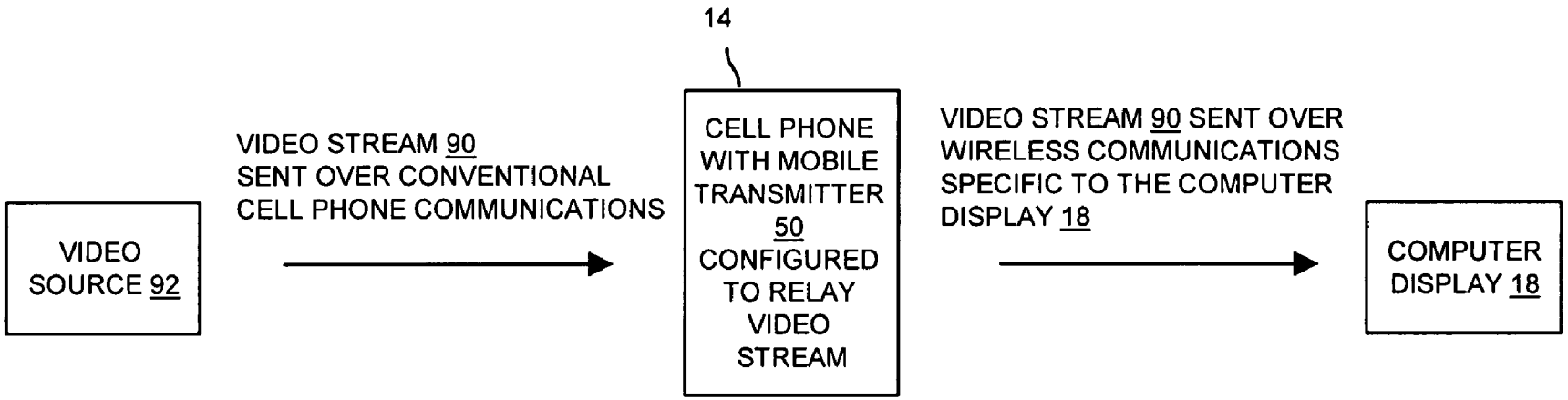
FIG. 4 is a block diagram of another information pathway which enables a user to view certain cellular phone video output on the computer display of FIG. 1.

FIG. 4 is a block diagram of an information pathway which enables a user to view, as cellular phone video output, a video feed on the computer display 18. Here, the external device 14 is a cell phone 80 which is configured to receive a video stream 90 from a video source 92. The video stream 90 may be a product made available to the user via subscription (e.g., a concert, a sports telecast, a current news transmission, stock market data, a purchased movie, etc.).

During operation, the user directs the cell phone (i.e., the external device 14) to acquire the video stream 90 over a cell phone channel or other conventional cell phone communications means. The user then directs the mobile wireless transmitter 50 (e.g., using Bluetooth technology, also see FIG. 1) of the cell phone to relay the video stream 90 to the computer display 18. Accordingly, the user can then view the video stream 90 on the screen 32 of the computer display 18. Such rendering provides better video quality than that offered by the miniature video display of the cell phone. Further details will now be provided with reference to FIG. 5.

As described above, embodiments of the invention are directed to techniques which enable a user to display information on a computer display 18 (e.g., a desktop computer monitor) through a wireless interface 36. Such an interface 36 is capable of receiving external information 48 from an external device 14 (i.e., a device other than the computer processor) such as a cellular telephone (or simply cell phone) configured to directly communicate with the computer display 18 in a wireless manner. As a result, if such a computer display 18 is available to the cell phone user (e.g., the user is at a location where there is such a computer display available), the user is not limited to viewing the miniature video display of a cell phone. Rather, the user is now capable of viewing cellular phone video output (e.g., a detailed digital picture, a video stream, live video conferencing, etc.) on the computer display 18.

While this invention has been particularly shown and described with references to preferred embodiments thereof, it will be understood by those skilled in the art that various changes in form and details may be made therein without departing from the spirit and scope of the invention as defined by the appended claims.

For example, the external device 14 was described above as being a cell phone by way of example only. In other arrangements, the external device 14 is an apparatus which is not a cell phone but some other type of portable device having a small video display screen (e.g., a personal organizer or pocket-sized PC, a cordless phone, a laptop computer which is separate from the workstation controller 16, a movie camera, a digital camera, a portable or hand held television, and the like).

Additionally, it should be understood that the computer display 18 was described above as being connected to a workstation controller 16 (e.g., a tower or mini-tower of a general purpose computer system) by way of example only. In other arrangements, the computer display 18 resides in a different context such as within a laptop computer, at a computer console to a mainframe, as part of a conference room projector system, and so on.

Furthermore, it should be understood that the applications described with reference to FIGS. 3 and 4 are provided by way of example only. There are other useful applications for the computer display 18 as well such as rendering video output as part of a video conferencing configuration in which the external device 14 (e.g., a cell phone) operates as the communications bridge, and the computer display 18 operates as the video screen for video conferences. Such enhancements and modifications are intended to belong to various embodiments of the invention.

What is claimed is:

1. A computerized system, comprising:

a workstation controller;

an external device which is different from the workstation controller; and a computer display having a screen, a workstation port, a wireless port and a display circuit;

the workstation port being configured to receive a workstation signal from the workstation controller;

the wireless port being configured to receive an external signal from the external device;

the display circuit being coupled to the screen, the workstation port and the wireless port; and the display circuit being configured to output (i) workstation information on the screen in response to the workstation signal from the workstation controller and (ii) external information on the screen in response to the external signal from the external device;

wherein the workstation port of the computer display is configured to connect to the workstation controller in a hardwired manner to enable the computer display and the workstation controller to form a computer workstation;

wherein the wireless port of the computer display is configured to acquire, as the external signal, a wireless transmission from a mobile wireless transmitter of the external device, the mobile wireless transmitter being external to the computer workstation;

wherein the external device is a hand held device having a small screen configured to render video output to a user, the screen of the computer display providing a viewing area which is larger than that of the small screen; wherein the wireless transmission carries a copy of the video output; and wherein the display circuit of the computer display is configured to extract the copy of the video output from the wireless transmission and display the copy of the video output on the screen of the computer display;

wherein the hand held device is configured to accept streaming video from a streaming video source; and wherein the video output displayed on the screen of the computer display is a copy of the streaming video which is relayed to the computer display from the streaming video source through the hand held device;

wherein the display circuit of the computer display includes: a switch configured to selectively enable and disable outputting of the external information on the screen of the computer display;

wherein the computer display includes a housing that encloses the screen, the workstation port, the wireless port, the display circuit, and the switch;

wherein the switch is configured to toggle between a first setting, a second setting, and a third setting;

wherein, when the switch is in the first setting, the switch activates the workstation port and disables the wireless port;

wherein, when the switch is in the second setting, the switch disables the workstation port and activates the wireless port; and wherein, when the switch is in the third setting:

the switch activates the workstation port, activates the wireless port, and isolates the workstation controller from the external device to prevent external intrusion into the workstation controller by the external device; and the display circuit concurrently outputs the workstation information and the video output on the screen of the computer display.

2. A computer display, comprising:

a screen;

a workstation port configured to receive a workstation signal from a workstation controller;

a wireless port configured to receive an external signal from an external device, the external device being different than the workstation controller; and a display circuit coupled to the screen, the workstation port and the wireless port, the display circuit being configured to output (i) workstation information on the screen in response to the workstation signal from the workstation controller and (ii) external information on the screen in response to the external signal from the external device;

wherein the workstation port is configured to connect to the workstation controller in a hardwired manner to enable the computer display and the workstation controller to form a computer workstation;

wherein the wireless port is configured to acquire, as the external signal, a wireless transmission from a mobile wireless transmitter of the external device, the mobile wireless transmitter being external to the computer workstation; and wherein the external device is a hand held device having a small screen configured to render video output to a user, the screen of the computer display providing a viewing area which is larger than that of the small screen; wherein the wireless transmission carries a copy of the video output; and wherein the display circuit of the computer display is configured to extract the copy of the video output from the wireless transmission and display the copy of the video output on the screen of the computer display;

wherein the hand held device is configured to accept streaming video from a streaming video source; and wherein the video output displayed on the screen of the computer display is a copy of the streaming video which is relayed to the computer display from the streaming video source through the hand held device;

wherein the display circuit includes: a switch configured to selectively enable and disable outputting of the external information on the screen;

further comprising a housing that encloses the screen, the workstation port, the wireless port, the display circuit, and the switch;

wherein the switch is configured to toggle between a first setting, a second setting, and a third setting;

wherein, when the switch is in the first setting, the switch activates the workstation port and disables the wireless port;

wherein, when the switch is in the second setting, the switch disables the workstation port and activates the wireless port; and wherein, when the switch is in the third setting:

the switch activates the workstation port, activates the wireless port, and isolates the workstation controller from the external device to prevent external intrusion into the workstation controller by the external device; and the display circuit concurrently outputs the workstation information and the video output on the screen of the computer display.

3. In a computer display of a computer workstation, a method for displaying information, the method comprising:

inputting a workstation signal from a workstation controller of the computer workstation through a workstation port of the computer display, and outputting workstation information on the computer display in response to the workstation signal;

receiving an external signal from an external device through a wireless port of the computer display, the wireless port being different than the workstation port, the external device being different than the workstation controller of the computer workstation; and displaying external information on the computer display in response to the external signal;

wherein the external device is a cellular phone having a wireless transmitter;

wherein receiving the external signal from the external device includes acquiring, as the external signal, a wireless transmission from the wireless transmitter of the cellular phone;

wherein the cellular phone further has a digital camera;

wherein displaying the external information includes outputting a digital photo captured by the digital camera of the cellular phone; and wherein the cellular phone is configured to accept streaming video from a streaming video source;

wherein displaying the external information includes outputting a copy of the streaming video which is relayed to the computer display from the streaming video source through the cellular phone;

further comprising receiving a toggling signal from a switch enclosed within a housing of the computer display to indicate a first setting, a second setting, and a third setting;

further comprising if the toggling signal indicates the first setting, activating the workstation port and disabling the wireless port;

further comprising if the toggling signal indicates the second setting, disabling the workstation port and activating the wireless port;

further comprising if the toggling signal indicates the third setting, activating the workstation port and activating the wireless port; and wherein, if the toggling signal indicates the third setting, activating the workstation port and activating the wireless port includes:

concurrently displaying the workstation information and the streaming video on the screen of the computer display; and isolating the workstation controller from the external device to prevent external intrusion into the workstation controller by the external device.

* * * * *

UNITED STATES PATENT AND TRADEMARK OFFICE

CERTIFICATE OF CORRECTION

PATENT NO. : 7,737,915 B1
APPLICATION NO. : 11/502017
DATED : June 15, 2010
INVENTOR(S) : Natan Vishlitzky It is certified that error appears in the above-identified patent and that said Letters Patent is hereby corrected as shown below:

On the title page item:

"(73) Assignee: EMC Corporation, Hopkinton, MA (US)" ---should be deleted from the cover page of the patent.

Signed and Sealed this
Fifth Day of July, 2011

David J. Kappos

David J. Kappos
*Director of the United States Patent and Trademark Office*